US006698672B1

(12) United States Patent
Linkletter et al.

(10) Patent No.: US 6,698,672 B1
(45) Date of Patent: Mar. 2, 2004

(54) BLOW GUN WITH EXTENSIBLE WAND

(75) Inventors: Don R. Linkletter, Cedar Rapids, IA (US); Steven R. Kunert, Cedar Rapids, IA (US)

(73) Assignee: Weems Industries, Inc., Marion, IA (US)

( * ) Notice: Subject to any disclaimer, the term of this patent is extended or adjusted under 35 U.S.C. 154(b) by 0 days.

(21) Appl. No.: 10/459,845

(22) Filed: Jun. 12, 2003

Related U.S. Application Data

(60) Provisional application No. 60/443,055, filed on Jan. 28, 2003.

(51) Int. Cl.[7] ..... B05B 9/01

(52) U.S. Cl. ..... 239/526; 239/525; 239/280; 239/280.5; 239/281; 239/532

(58) Field of Search ..... 239/280, 280.5, 239/281, 525, 532, 526, 600

(56) References Cited

U.S. PATENT DOCUMENTS

| | | | | |
|---|---|---|---|---|
| 5,832,974 A | * | 11/1998 | Jou | 239/600 |
| 6,216,965 B1 | * | 4/2001 | Chao | 239/280 |
| 6,220,527 B1 | * | 4/2001 | Chen et al. | 239/532 |
| 6,283,340 B1 | * | 9/2001 | Waldner | 222/530 |
| 6,619,570 B1 | * | 9/2003 | Ericksen et al. | 239/532 |
| 2002/0066803 A1 | * | 6/2002 | Hsu | 239/532 |

* cited by examiner

*Primary Examiner*—Robin O. Evans
(74) *Attorney, Agent, or Firm*—Allan L. Harms

(57) ABSTRACT

A blow gun with an extensible wand includes a barrel for receiving and storing the wand. The wand passes through an inner collar and an outer collar, the inner collar mounted to the barrel and the outer collar eccentrically rotatable upon the inner collar. Rotation of the outer collar affects alignment of the bore of the outer collar with the bore of the inner collar. When the misalignment of the bores is increased, the wand is locked in a selected extension from the barrel.

16 Claims, 5 Drawing Sheets

BLOW GUN WITH EXTENSIBLE WAND

CROSS REFERENCE TO RELATED APPLICATIONS

This application claims priority from copending provisional patent application entitled "BLOW GUN WITH EXTENSIBLE WAND", Ser. No. 60/443,055 filed Jan. 28, 2003. The disclosure of provisional patent application Ser. No. 60/443,055 is hereby incorporated in its entirety.

STATEMENT REGARDING FEDERALLY SPONSORED RESEARCH OR DEVELOPMENT

Not applicable

BACKGROUND OF THE INVENTION

The present invention pertains to compressed air blow guns. A blow gun to direct compressed air is a common tool used in factories, workshops and around trucks and other vehicles. Blow guns are frequently used around large truck tractors for the occasional need to use compressed air to expel debris and dust from a truck trailer or truck cab or sleeper and for other uses, as well as to inflate tires when the blow gun is equipped with an inflation chuck. The blow gun is coupled to an air hose coupled to a supply of compressed air which may be connected to the compressed air system of the truck tractor.

Adjustability of the length of the wand is a desirable feature in order to make the blow gun more versatile. An improvement for the standard fixed wand blow gun is shown in U.S. Pat. No. 5,832,974 to Jou which shows a blow gun with an adjustable wand. The prior art blow gun allows the wand to be adjusted by use of a threaded sleeve which urges clamping fingers into abutment with the outside of the wand of the blow gun. Adjustment of the extension of the wand requires the loosening of the threaded sleeve to a point which releases the clamping fingers and the retightening of the sleeve when the desired wand extension is made.

SUMMARY OF THE INVENTION

The present invention provides a blow gun with an extensible wand. Extension or retraction of the wand of the blow gun is accomplished by releasing the wand by rotation of a collar less than one half turn in either direction. The invention includes a handle having a trigger lever which opens a valve to permit compressed air from a source hose coupled to the handle to pass through the handle into an elongate wand on the end of which a nozzle may be mounted or alternatively a tire inflation chuck member may be mounted. The handle includes a barrel which serves as a storage housing for the wand when it is retracted. The wand through which compressed air may pass is adjustable in length by sliding it inwardly or outwardly longitudinally from the barrel of the handle. The wand may be extended to a desired length and locked into the particular extension position by use of an outer collar which is eccentrically rotatable upon an inner collar. The inner collar has a first section and an externally threaded extension which extends longitudinally from the first section. The extension is not coaxial with the first section but a longitudinal bore through the inner collar is coaxial with the first section and therefore is offset from the axis of the extension. The bore through the first section is internally threaded and sized to mount to the threads on the end of the barrel while the bore through the extension is smooth and is sized to permit the wand to be slid through it. The outer collar includes a threaded bore to receive the external threads of the extension of the inner collar. The threaded bore does not extend through the outer collar but rather longitudinally joins a smaller bore which is sized larger than the outer diameter of the wand. The axis of the smaller bore is slightly displaced from but parallel to the axis of the threaded bore of the outer collar. A ridge is formed longitudinally on the exterior of the outer collar to provide a lever to easily rotate the outer collar on the inner collar and to provide an indexing means.

Rotation of the outer collar less than one half of a turn will cause the bore of the outer collar to move such that the bore of the inner collar is no longer in registry with the small bore of the outer collar. Hence the outer collar forces the wand against the bore in the extension of the inner collar and thereby locks the wand in its then longitudinal position.

It is an object of the invention to provide a versatile blow gun which includes a wand which can quickly and simply be extended or retracted when released by less than a half turn of a collar surrounding the wand.

It is a further object of the invention to provide a blow gun with a variable length wand which may be extended or retracted without removing the wand from the handle of the blowgun.

It is also an object of the invention to provide an improved blow gun which allows for extension or retraction of the wand thereof without the use of numerous clamping parts mounted to the handle of the blow gun.

BRIEF DESCRIPTION OF THE SEVERAL VIEWS OF THE DRAWING(S)

DETAILED DESCRIPTION OF THE INVENTION

Figure 1:
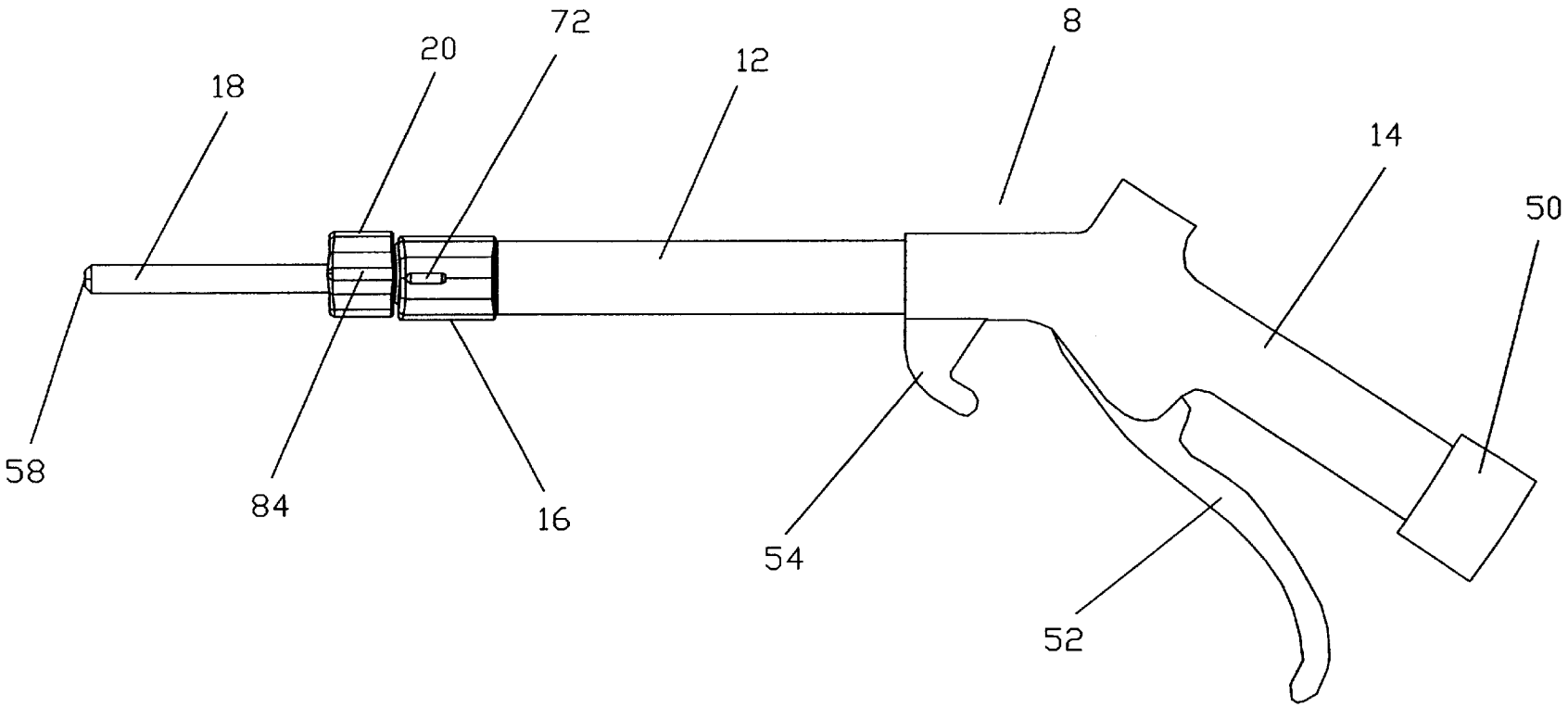
FIG. 1 is a front elevation of the invention with the wand in a retracted position.

The assembled blow gun invention is illustrated in FIG. 1 with wand 18 in a retracted, released position so that wand 18 may be extended. Blow gun 8 comprises a handle 14 which includes intake port 50 and contains an internal actuable valve to selectively allow compressed air to pass through handle 14 and through barrel 12 and wand 18 and to be expressed from nozzle 58. The internal valve of the handle is opened by movement of trigger 52 towards handle 14 in a conventional manner. A hook 54 is formed on handle 14 to provide a structure for suspending handle 14. Barrel 12 has inner collar 16 mounted thereto with outer collar 20 mounted to inner collar 16. The ridge 84 of outer collar 20 is aligned with protrusion 72 of inner collar 16 indicating that outer collar 20 is positioned such that wand 18 is free to be adjusted.

Figure 2:
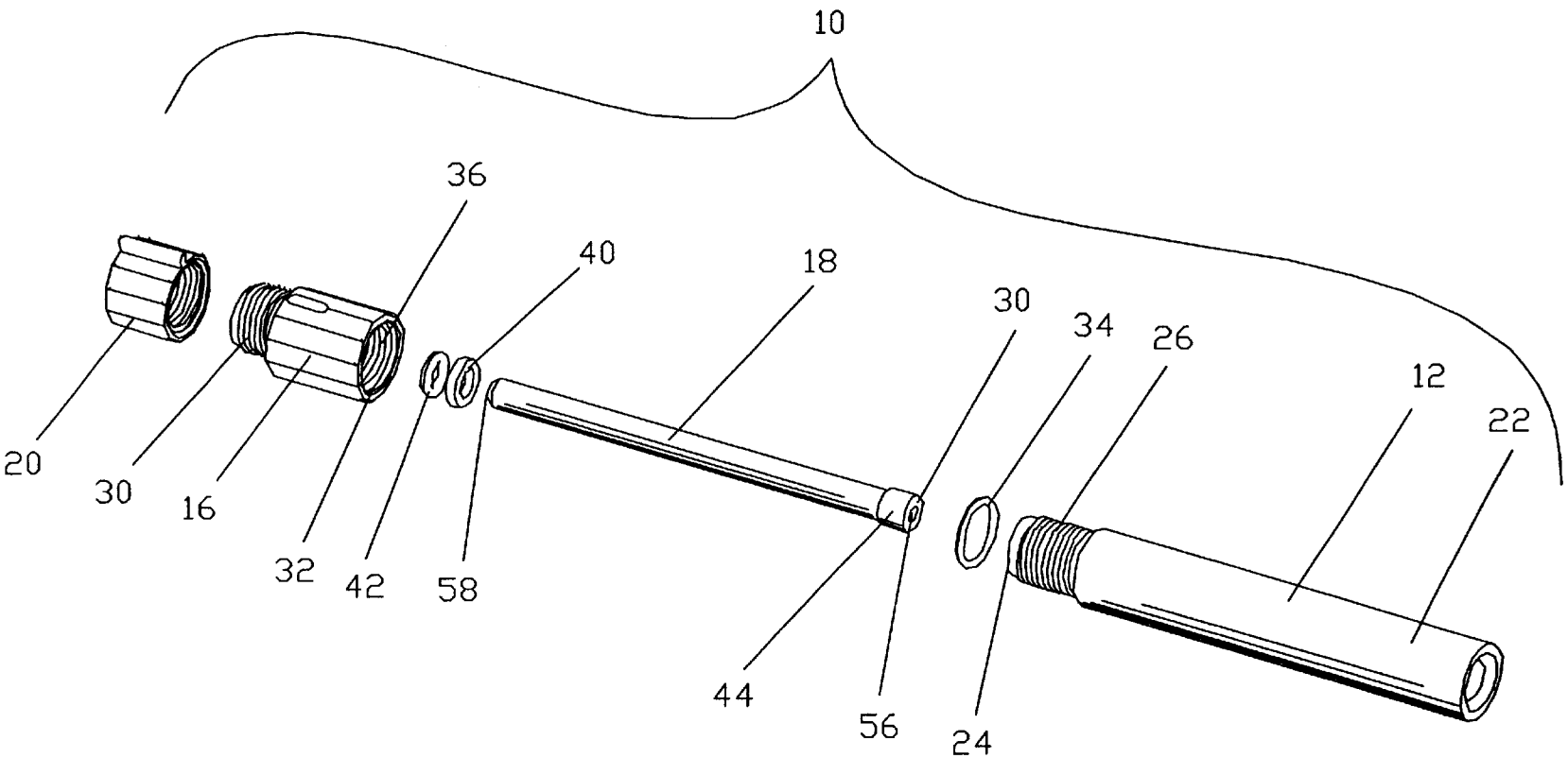
FIG. 2 is an exploded view in perspective of the barrel and wand assembly of the blow gun invention.

Now referring also to FIG. 2, barrel assembly 10 is shown in exploded view. Elongate hollow barrel 12 is mountable at its first end 22 to the handle 14 by conventional screw thread means or by other means such as bayonet mounting. Opposing second end 24 of barrel 12 includes external screw threads 26 for receiving inner collar 16. Wand 18 is selectively slidably receivable within barrel 12 in a longitudinal fashion. Outer collar 20 is receivable upon externally threaded distal end 30 of inner collar 16. Inner collar 16 is receivable at its proximal end 32 upon threads 26 of barrel 12. Inner collar 16 is securely mounted to barrel 12 while outer collar 20 is manually rotatable over a limited range relative to inner collar 16.

Large O-ring 34 is receivable within bore 36 of inner collar 16 to provide a seal between barrel 12 and inner collar 16. Ring seals 40, 42 are slidably received around wand 18 to provide a seal around it. Wand 18 is provided with enlarged shoulder 44 at its proximal end 38. Shoulder 44 functions as a stop against ring seals 40, 42 when wand 18 is maximally extended from barrel 12. Wand 18 is provided with longitudinal bore 56 therethrough terminating with nozzle 58.

Figure 3:
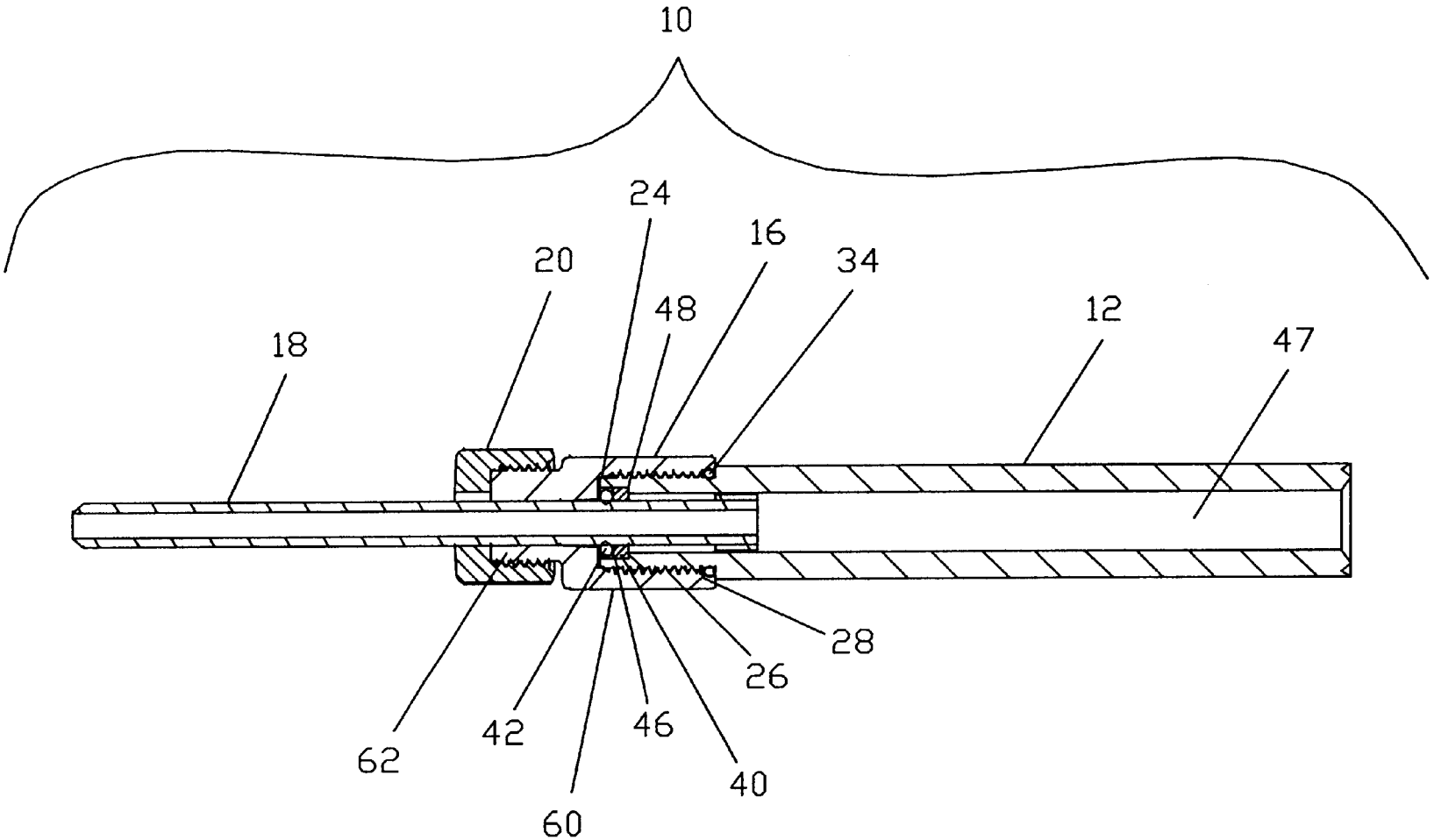
FIG. 3 is a cross section of the barrel assembly of the invention taken along its longitudinal axis.

Referring now additionally to FIG. 3, the assembled barrel assembly 10 is shown in longitudinal cross section with wand 18 at an intermediate extension from barrel 12. Barrel 12 comprises longitudinal bore 47 which includes enlarged counter bore 48 adjacent second end 24 thereof. Large elastomeric O-ring 34 is positioned at the proximal end 28 of threads 26 such that inner collar 16 is sealed to barrel 12. Semi-rigid ring seal 40 and elastomeric ring seal 42 surround wand 18 and are retained in a gap 46 formed by enlarged counter bore 48 of barrel 12. Semi-rigid ring seal 40 is preferably made from nylon. Inner collar 16 is mounted securely upon screw threads of barrel 12 and outer collar 20 is in place on extension 60 of inner collar 16.

Figure 5:
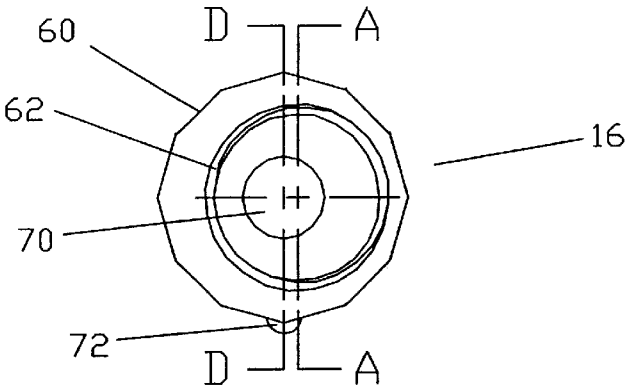
FIG. 5 is a top plan view of the inner collar of FIG. 3.
Figure 4:
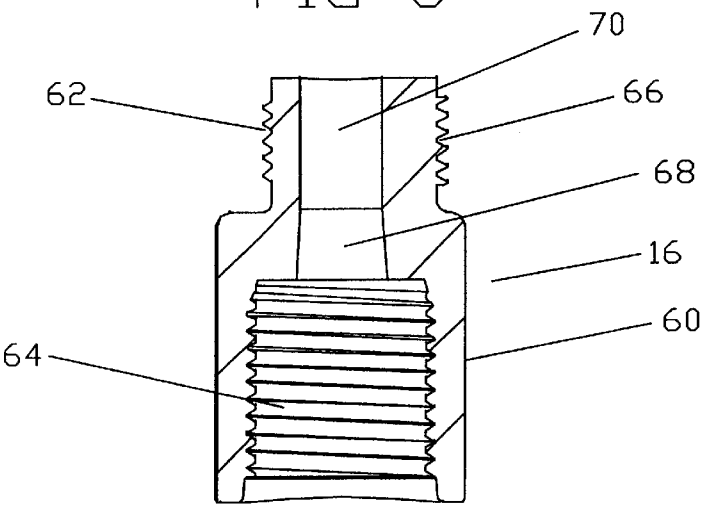
FIG. 4 is a cross section of the inner collar of the barrel assembly of the invention.

Referring now also to FIGS. 4 and 5, it can be observed that inner collar 16 comprises first section 60 and includes extension 62 joined integrally to first section 60. Preferably inner collar 16 will be formed from nylon or another rigid polymer or of metal. Inner collar 16 comprises internal threaded bore 64 in first section 60 thereof which is communicative with tapered passageway 68 which interconnects smooth bore 70 of extension 62 to threaded bore 64. Smooth bore 70 is sized to allow wand 18 to slide snugly yet easily therealong and is coaxial with threaded bore 64 which is sized to receive second end 24 of barrel 12. It can be seen in FIGS. 4 and 5 that smooth bore 70 is coaxial with first section 60 of inner collar 16 while extension 62 is offset on first section 60 such that it is not centered on first section 60. In the preferred embodiment, the offset of axis A—A of extension 62 from the centerline D—D of first section 60 is approximately 0.040 inches.

Extension 62 is provided with external screw threads 66 therealong. A protrusion 72 is formed on the periphery of first section 60 of inner collar 16 to allow indexing of the outer collar 20 therewith. First section 60 is preferably textured on its outer surfaces.

Figure 7:
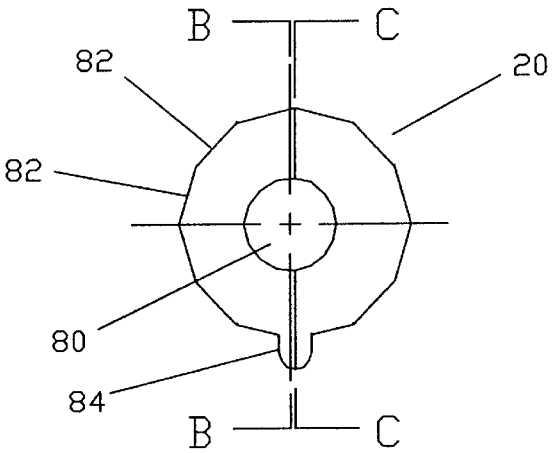
FIG. 7 is a top plan view of the outer collar of the barrel assembly of the invention.
Figure 6:
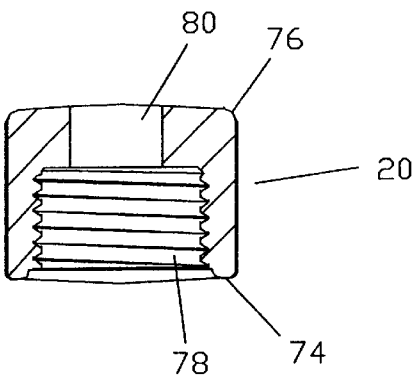
FIG. 6 is a cross section of the outer collar of the barrel assembly of FIG. 1.

Referring now to FIGS. 6 and 7, details of outer collar 20 may be visualized. Outer collar 20 is preferably constructed of nylon of another rigid polymer or of metal, and comprises internal threaded bore 78 opening at proximal end 74 of outer collar 20, and smooth bore 80 opening at distal end 76 of outer collar 20. The exterior of outer collar 20 is multi-sided, comprising segments 82 which facilitate manual rotation of outer collar 20 relative to inner collar 16. The periphery of outer collar 20 also includes longitudinal ridge 84 which is formed on outer collar 20 to provide indexing means and is oriented on outer collar 20 such that when ridge 84 is aligned with protrusion 72 of inner collar 16, the smooth bore 80 of outer collar is in registry with smooth bore 70 of inner collar 16. Specifically, the entire area of smooth bore 70 of inner collar 16 is within, but not centered in, the area of smooth bore 80 when ridge 84 is aligned with protrusion 72. When outer collar 20 is rotated such that ridge 84 is not aligned with protrusion 72, at least some portion of smooth bore 70 is not in registry with smooth bore 80 of outer collar 20. It should be understood that the centerline B—B of smooth bore 80 of outer collar 20 is parallel to but slightly offset from the centerline C—C of outer collar 20. In the preferred embodiment, the offset is in the approximate range of 0.012 to 0.016 inches, preferably about 0.014 inches. Therefore, when outer collar 20 is rotated such that ridge 84 is out of longitudinal alignment with protrusion 72 of inner collar 16, smooth bore 80 of outer collar 20 is offset by an increasing distance from smooth bore 70 of inner collar 16. As outer collar 20 is rotated, smooth bore 80 thereof applies side force to wand 18 and forces it against a side of smooth bore 70 of inner collar 16.

In the preferred embodiment, the smooth bore 80 of outer collar 20 is slightly larger than the smooth bore 70 of the inner collar 16. Preferably, the diameter of smooth bore 80 is 0.290±0.002 inches and the diameter of smooth bore 70 is 0.243±0.002 inches. The diameter of the wand 18 is preferably approximately 0.236 inches and wand 18 therefore slides snugly but without interference within inner collar 16.

When outer collar 20 is rotated to a position where ridge 84 thereof is aligned with protrusion 72 of inner collar 16, smooth bore 70 is in registry with but not centered on smooth bore 80 of outer collar 20. When outer collar 20 is rotated away from the position in which ridge 84 is aligned with protrusion 72, shear force is applied to wand 18 from misalignment of smooth bore 70 with smooth bore 80.

The amount of rotation of outer collar 20 needed to sufficiently offset smooth bore 80 from smooth bore 70 is approximately one quarter turn, in order for adequate shear force to be applied along wand 18 to bind it and thereby to restrain longitudinal movement of wand 18 in relation to barrel 12. By rotating outer collar 20 into alignment of ridge 84 thereof with protrusion 72 of inner collar 16, the axis of smooth bore 80 of outer collar 20 is oriented such that its axis B—B is in closest proximity with the axis of smooth bore 70 of inner collar 16 and smooth bore 70 is in registry with smooth bore 80 of outer collar 20. In that disposition, wand 18 may be moved longitudinally into a desired position, whereupon outer collar 20 may then be rotated to sufficiently bind wand 18 into a temporarily fixed extended position.

Having described the invention, we claim:

1. An improved blowgun comprising an elongate housing for slidably receiving an elongate wand, the housing selectively coupled to a source of compressed air at a first end thereof, the wand extensible from a second end of the housing, a first collar mounted to the second end of the housing, the first collar annularly surrounding the wand, a second collar mounted to the first collar and selectively moveable thereon, the second collar annularly surrounding the wand, the second collar is rotatably moveable upon the first collar, the first collar comprises a first section and an extension fixed to the first section, the extension having an axis parallel to and noncoaxial with a longitudinal axis of the first section of the first collar, the second collar applying shear force to the wand when the second collar is selectively moved upon the first collar.

2. The improved blowgun of claim 1 wherein the second collar is rotatably moveable upon the first collar.

3. The improved blowgun of claim 2 wherein the first collar having a longitudinal bore through the extension thereof, the second collar having a longitudinal bore therethrough, the bore of the second collar selectively alignable with the bore of the extension of the first collar.

4. The improved blowgun of claim 3 wherein the second collar has a longitudinal axis parallel to and spaced apart from an axis of the longitudinal bore thereof.

5. The improved blowgun of claim 4 wherein the axis of the extension of the first collar offset from the axis of the longitudinal bore of the first collar approximately 0.040 inches.

6. The improved blowgun of claim 5 wherein the longitudinal axis of the second collar offset from the axis of the longitudinal bore thereof by approximately 0.014 inches.

7. The improved blowgun of claim 6 wherein the bore of the second collar is larger than the bore of the extension of the first collar, the second collar is rotatable upon the extension of the first collar over a limited range, the second collar rotatable into a position wherein the bore of the extension of the first collar is aligned with the bore of the second collar.

8. An improved blowgun comprising a handle member having a passageway therethrough and having an internal valve for controlling flow of compressed air through the passageway therethrough, the handle member having an inlet and an outlet, the handle member having an elongate housing intermediate the outlet and the valve thereof, an elongate wand having a longitudinal bore therethrough, the bore of the wand communicative with the passageway through the handle member, the wand longitudinally slidable within the elongate housing, a first collar mounted to a free end of the elongate housing, the first collar having a bore therethrough, the bore of the first collar having an axis, the wand slidably disposed within the bore of the first collar, the first collar including an extension thereon, the bore of the first collar extending through the extension, the extension having an axis parallel to and offset from the axis of the bore of the first collar, a second collar receivable upon the extension, the second collar having a longitudinal bore therethrough, the wand disposed within the longitudinal bore of the second collar, the second collar rotatable upon the extension of the first collar, the bore of the second collar selectively disposed to align the bore of the extension of the first collar with the bore of the second collar, whereby rotation of the second collar selectively prevents longitudinal movement of the wand.

9. The improved blowgun of claim 8 wherein the second collar has a longitudinal axis, the longitudinal bore of the second collar parallel to but offset from the longitudinal axis of the second collar.

10. The improved blowgun of claim 8 wherein the longitudinal bore of the second collar larger in diameter than the bore of the first collar.

11. The improved blowgun of claim 8 wherein the first collar having an enlarged threaded bore on an end opposing the extension thereof, the threaded bore of the first collar received on the free end of the elongate housing.

12. The improved blowgun of claim 8 wherein the extension of the first collar has external threads thereon, the second collar having an enlarged bore receivable upon the extension of the first collar, the enlarged bore of the second collar coaxial with the longitudinal bore thereof.

13. The improved blowgun of claim 8 wherein the second collar has a longitudinal axis, the bore of the second collar parallel to but offset from the longitudinal axis of the second collar.

14. The improved blowgun of claim 8 wherein the second collar has a longitudinal axis, the longitudinal bore of the second collar parallel to but offset from the longitudinal axis of the second collar, the longitudinal bore of the second collar larger in diameter than the bore of the first collar, the second collar has a longitudinal axis, the bore of the second collar parallel to but offset from the longitudinal axis of the second collar.

15. The improved blowgun of claim 14 wherein the longitudinal bore of the second collar having a diameter of approximnately 0.290 inches, the bore of the first collar through the extension thereof is offset from the longitudinal axis of the extension by approximately 0.040 inches.

16. An improved blowgun comprising an elongate housing for slidably receiving an elongate wand, the housing selectively coupled to a source of compressed air at a first end thereof, the wand extensible from a second end of the housing, a first collar mounted to the second end of the housing, the first collar annularly surrounding the wand, a second collar mounted to the first collar and selectively moveable thereon, the second collar annularly surrounding the wand, the first collar comprises a first section and an extension fixed to the first section, the extension having an axis parallel to and noncoaxial with a longitudinal axis of the first section of the first collar.

* * * * *